US007850097B2

(12) United States Patent
Tseng et al.

(10) Patent No.: US 7,850,097 B2
(45) Date of Patent: Dec. 14, 2010

(54) AERATING NOZZEL ASSEMBLY

(76) Inventors: Kuo-Tang Tseng, 5F. No. 51, Lane 559, Sec. 4, Jhongsiao E. Rd., Taipei (TW); Kuo-Hung Tseng, 5F, No. 51, Lane 559, Sec. 4, Jhongsiao E. Rd., Taipei (TW)

( * ) Notice: Subject to any disclaimer, the term of this patent is extended or adjusted under 35 U.S.C. 154(b) by 206 days.

(21) Appl. No.: 12/176,176

(22) Filed: Jul. 18, 2008

(65) Prior Publication Data

US 2010/0012752 A1 Jan. 21, 2010

(51) Int. Cl.
*E03C 1/08* (2006.01)

(52) U.S. Cl. ..... 239/428.5; 239/419.5; 239/425.5

(58) Field of Classification Search ..... 239/318, 239/419.5, 428.5, 425.5, 558, 423–425, 556, 239/557

See application file for complete search history.

(56) References Cited

U.S. PATENT DOCUMENTS 4,412,568 A * 11/1983 Hughes ..... 141/392
6,237,897 B1 * 5/2001 Marina ..... 261/64.1
7,306,045 B1 * 12/2007 Moflihi ..... 169/70

* cited by examiner

*Primary Examiner*—Christopher S Kim
(74) *Attorney, Agent, or Firm*—patenttm.us

(57) ABSTRACT

An aerating nozzle assembly has at least one aerating nozzle, and each aerating nozzle has a body, an annular air casing and at least one air tube. The body is tubular and has a channel and a constriction. The constriction is formed around the body and has multiple air holes formed through the constriction and communicating with the channel. The annular air casing is hollow and is mounted around the air holes in the constriction and has an air chamber, an annular surface and at least one air supply hole formed through the annular surface. The at least one air tubes are mounted securely respectively in the air supply holes. Accordingly, the air holes around the constriction allow air to be drawn into the liquid and more completely and homogenously aerate the liquid.

3 Claims, 11 Drawing Sheets

AERATING NOZZEL ASSEMBLY

BACKGROUND OF THE INVENTION

1. Field of the Invention

The present invention relates to an aerating nozzle assembly, and more particularly to an aerating nozzle assembly that homogenously mixes air or another substance with liquid pumped through the aerating nozzle assembly and accelerates aerated liquid discharged from the nozzle assembly.

2. Description of Related Art

Venturi tubes are widely used in various applications. One application mixes liquid and air to aerate the liquid to facilitate burning or increase oxygen content of the liquid. Related aerating nozzles such as water aspirators, atomizers or carburetors are examples.

With reference to FIGS. 10 and 11, an aerating nozzle typically comprises a body (20) and an air tube (22).

The body (20) is tubular and has an inlet, an outlet, a middle, a channel and a constriction (21). The channel is defined longitudinally through the body (20). The constriction (21) is formed coaxially in the middle of the body (20), communicates with the channel and has an air hole (210). The air hole (210) is formed through the body (20) at the constriction (21) and communicates with the channel.

The air tube (22) is connected perpendicularly to and protrudes from the air hole (210) and communicates with the channel in the constriction (21) and ambient air.

When a pump liquid through the body (20), liquid accelerates as it enters the constriction (21) space and draws air through the air hole (210) and the tube (22) into the liquid and discharges the aerated liquid from the outlet of the body (20) as a aerated liquid.

However, since the constriction (21) only has one air hole (210) through which air is drawn, the amount of air drawn into the liquid is not adequate to completely aerate the liquid.

Furthermore, liquid leaving the constriction (21) decelerates, which allow suspended bubbles to combine and reduces the efficiency of the aerating nozzle.

To overcome the shortcomings, the present invention provides an aerating nozzle to obviate or mitigate the aforementioned problems.

SUMMARY OF THE INVENTION

The main objective of the present invention is to provide an aerating nozzle assembly that more completely and homogenously aerates the liquid and accelerates the aerated liquid before it is discharged.

To achieve the objective, the aerating nozzle assembly in accordance with present invention has a nebulizing device and at least one air tube. The nebulizing device comprises a body, an annular air casing and an acceleration cap.

The body is tubular and has an inlet, an outlet, a middle, a channel and a constriction. The channel is defined longitudinally through the body. The constriction is formed in the middle of the body and has a constricted space and a plurality of air holes. The constricted space is defined in the constriction and communicates with the channel. The air holes are formed through the constriction diametrically and communicate with the constricted space.

The annular air casing is airtightly formed around the constriction of the body and defines an air chamber communicating with all of the air holes on the constriction.

The acceleration cap is a hollow frustum, is formed concentrically on and constricts the outlet of the body and defines a constricted inner surface and a discharging hole being adjacent to the constricted inner surface and communicating with the channel of the body.

The at least one air tube attaches securely to the annular air casing and communicates the air chamber of the annular air casing with outer environment (or an annular air casing of other nebulizing device).

With an external compressor and liquid supplying pipes connecting to the inlet of the body, pressurized liquid flows through the constriction, air is drawn through the air holes to aerate the liquid completely, and aerated liquid passing through the acceleration cap is accelerated and discharged in a stream.

Accordingly, since there are a plurality of air holes being formed on the constriction to infuse the air, the liquid may completely nebulized with sufficient air.

Otherwise, the acceleration cap speeds up the spray that discharged, such that the aerating nozzle assembly having the nebulizing device may provide high performance when used.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
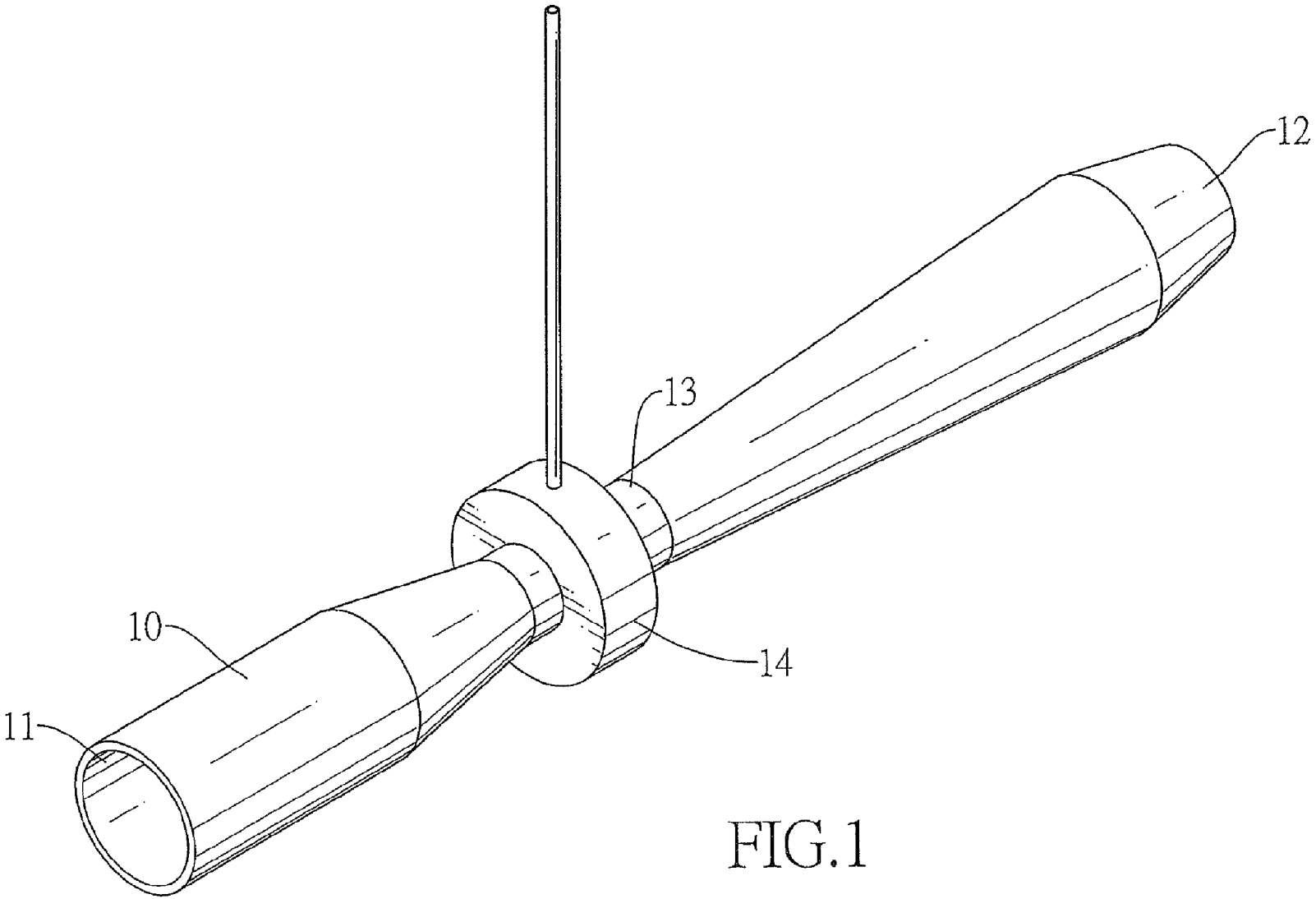
FIG. 1 is a perspective view of a nebulizing device of the aerating nozzle assembly in accordance with the present invention.
Figure 2:
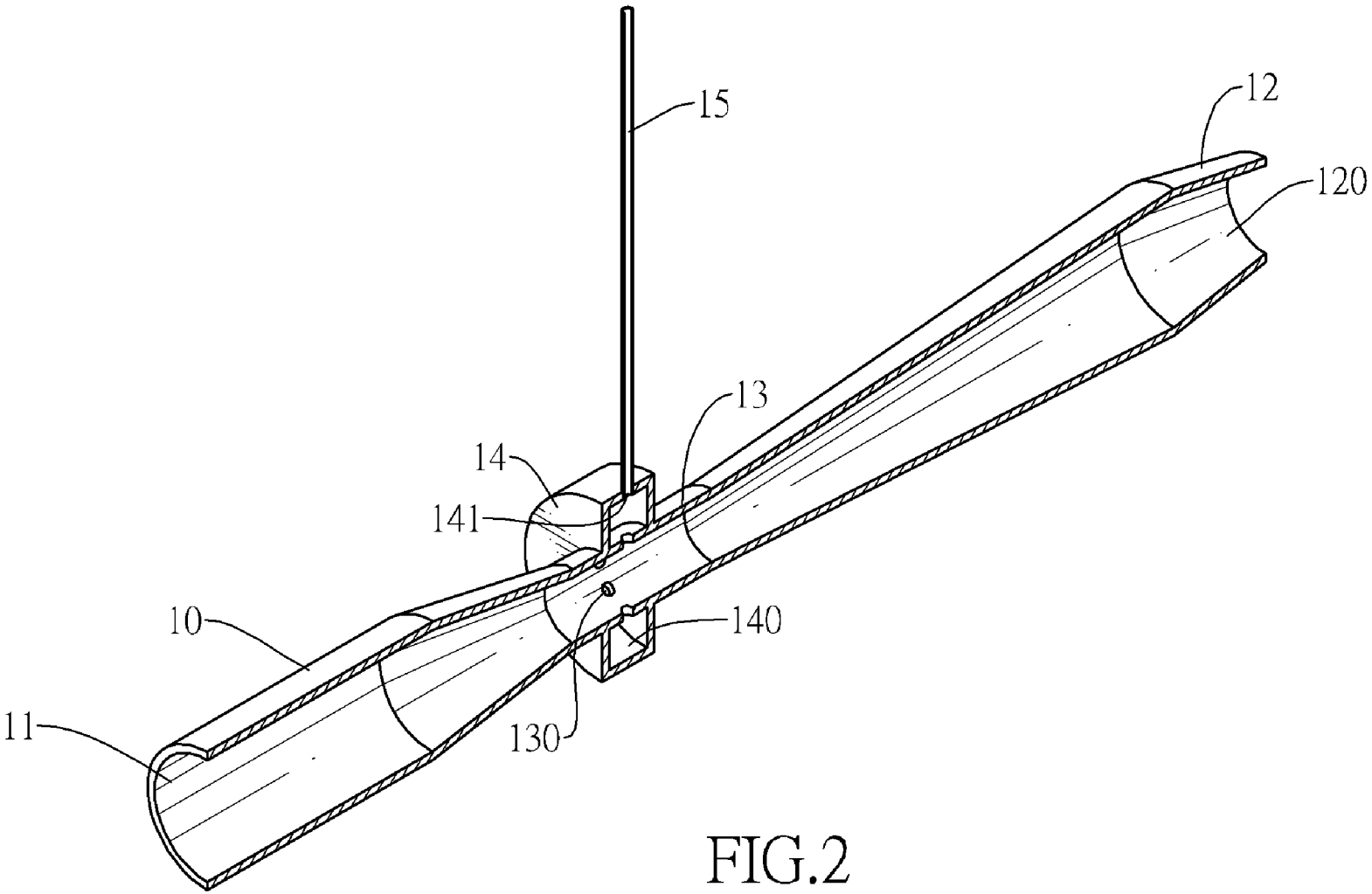
FIG. 2 is a cross sectional perspective view of the nebulizing device in FIG. 1.

With reference to FIGS. 1, 2, 7, and 8, the aerating nozzle assembly in accordance with present invention comprises a nebulizing device and at least one air tube (15). The nebulizing device comprises a body (10), an annular air casing (14), an acceleration cap (12), an optional muzzle (17) and an optional turbine (18).

The body (10) is tubular and has an inlet (11), an outlet, a middle, a channel and a constriction (13). The channel is defined longitudinally through the body (10). The constriction (13) is formed in the middle of the body (10) and has a constricted space and a plurality of air holes (130). The constricted space is defined in the constriction (13) and communicates with the channel. The air holes (130) are formed through the constriction (13) diametrically and communicate with the constricted space.

The annular air casing (14) is airtightly formed around the constriction (13) of the body (10) and has an air chamber (140), an annular surface and at least one air supply hole (141). The air chamber (140) is formed inside the annular air casing (14) and communicates with the air holes (130). The at least one air supply hole (141) is formed through the annular surface and communicates with the air chamber (140).

The acceleration cap (12) is a hollow frustum, is formed concentrically on and constricts the outlet of the body (10) and defines a constricted inner surface and a discharging hole (120) being adjacent to the constricted inner surface and communicating with the channel of the body (10).

The at least one air tube (15) attaches securely to the annular air casing (14) and communicates the air chamber (140) of the annular air casing (14) with outer environment.

Figure 7:
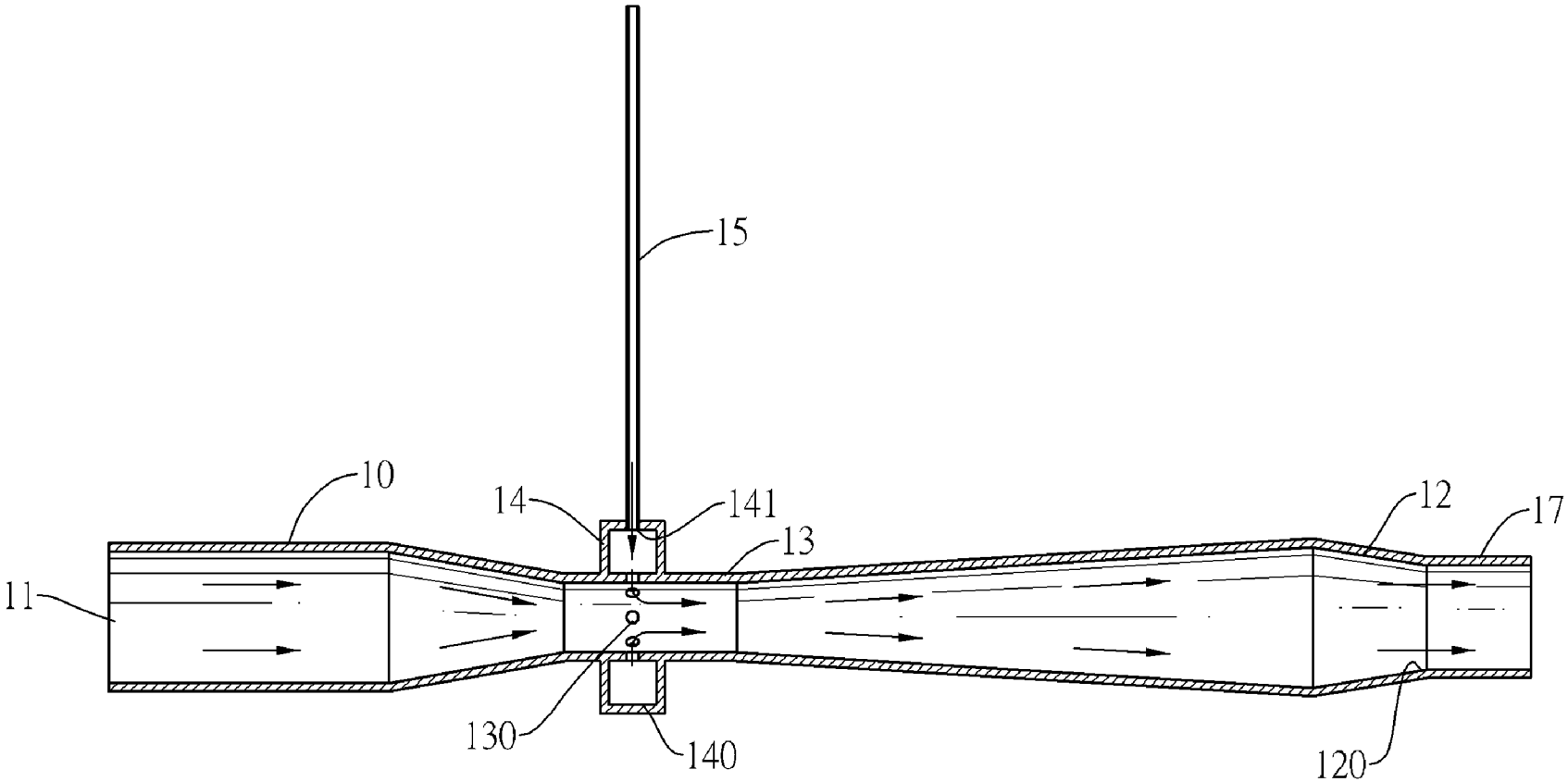
FIG. 7 is a cross sectional side view of a third embodiment of a nebulizing device in accordance with the present invention.

With further reference to FIG. 7, the muzzle (17) is tubular, has an end attached securely to the acceleration cap (12) around the discharging hole (120) and a through hole formed longitudinally through the muzzle (17) to communicate with the discharging hole (120).

Figure 3:
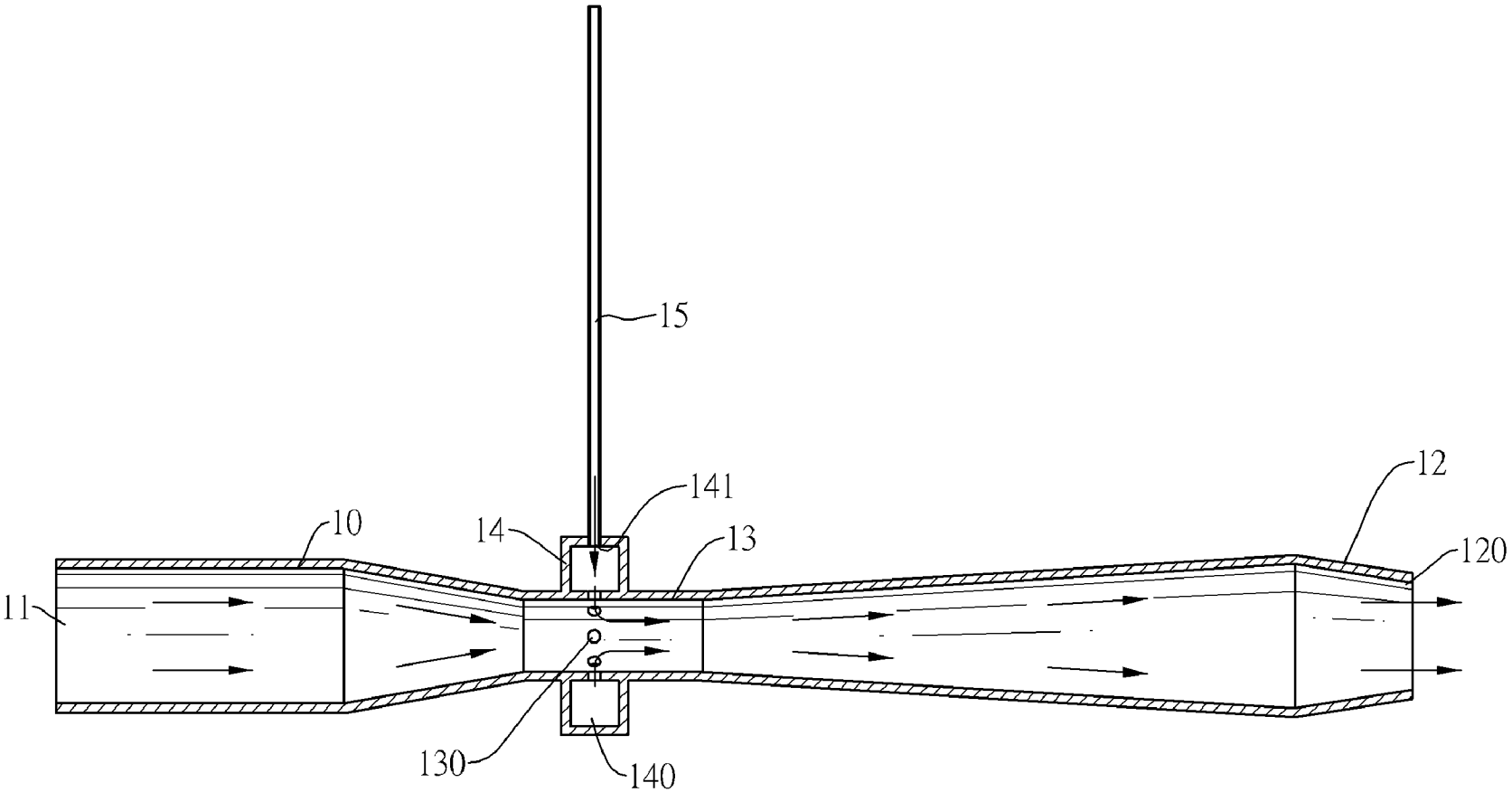
FIG. 3 is an operational cross sectional side view of the nebulizing device in FIG. 1.
Figure 4:
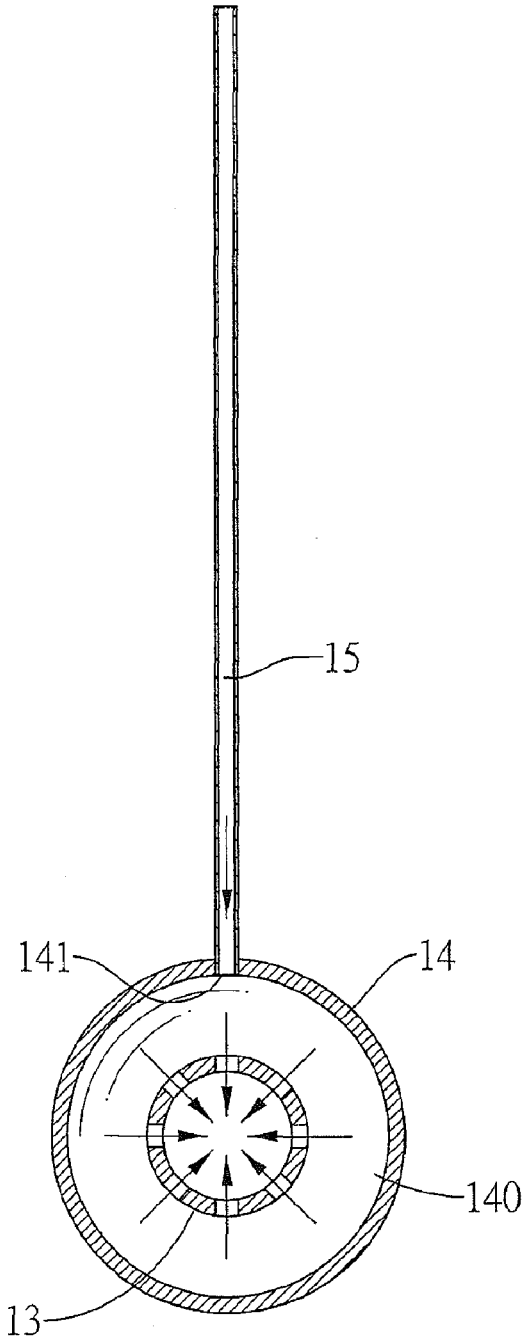
FIG. 4 is an operational cross sectional end view of the nebulizing device in FIG. 1.

With further reference to FIGS. 3 and 4, with an external compressor and liquid supplying pipes connecting to the inlet (11) of the body (10), pressed liquid may pass through the constricted space and mixed up with the air coming in from all of the air holes (130) to form a spray. When the spray flow through the air channel of the body (10) and into the acceleration cap (12), the spray will be accelerated via the constricted inner surface of the acceleration cap (12) and may eventually concentrated by the muzzle (17) and discharged from the discharging hole (120) of the acceleration cap (12).

Figure 8:
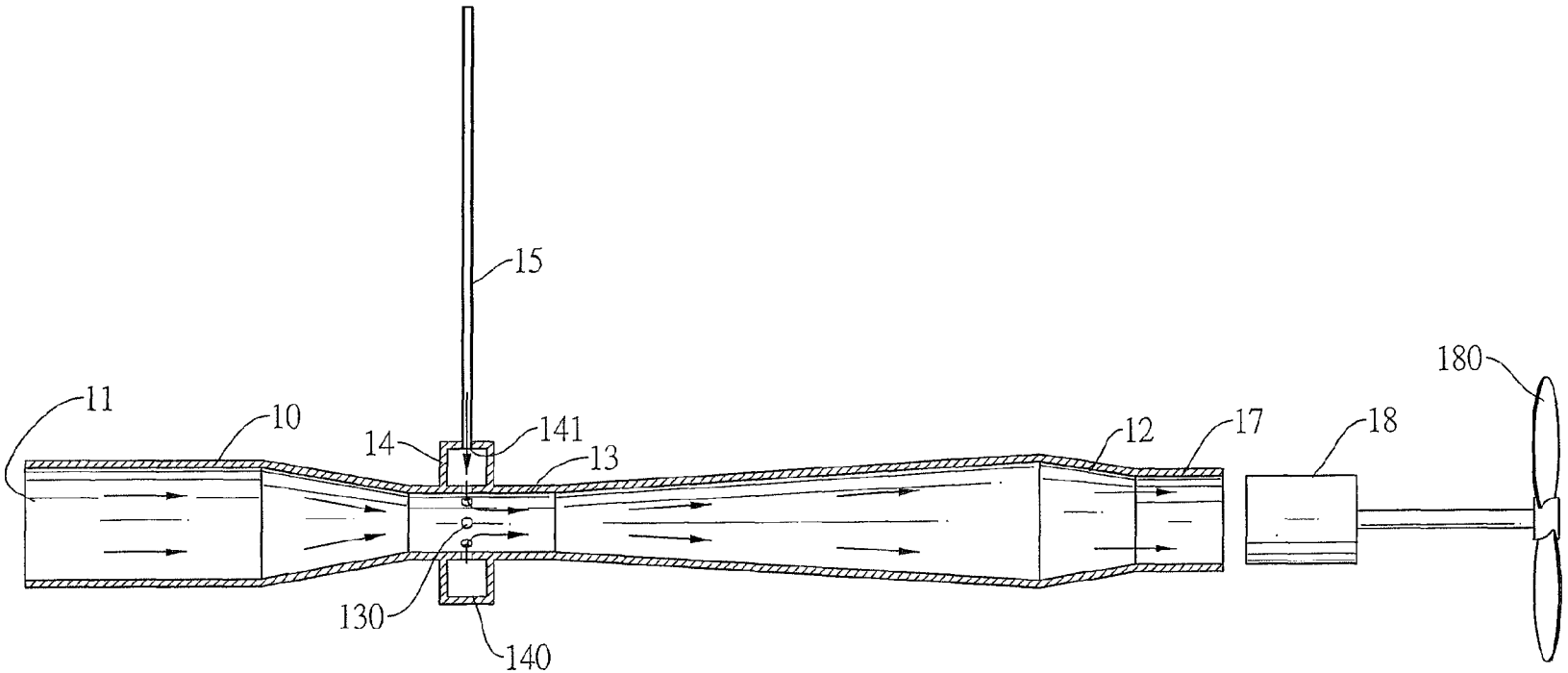
FIG. 8 is a cross sectional side view of a fourth embodiment of a nebulizing device of the aerating nozzle assembly in accordance with the present invention.

With further reference to FIG. 8, the turbine (18) is mounted in front of the through hole of the muzzle (17) and drives a propeller (180) to rotate to additionally accelerate the spray.

Accordingly, since there are a plurality of air holes (130) being formed on the constriction (13) to infuse the air, the liquid may completely nebulized with sufficient air. Otherwise, the acceleration cap (12) and the turbine (18) speeds up the spray that discharged, such that the nebulizing device may provide high performance when used.

Figure 5:
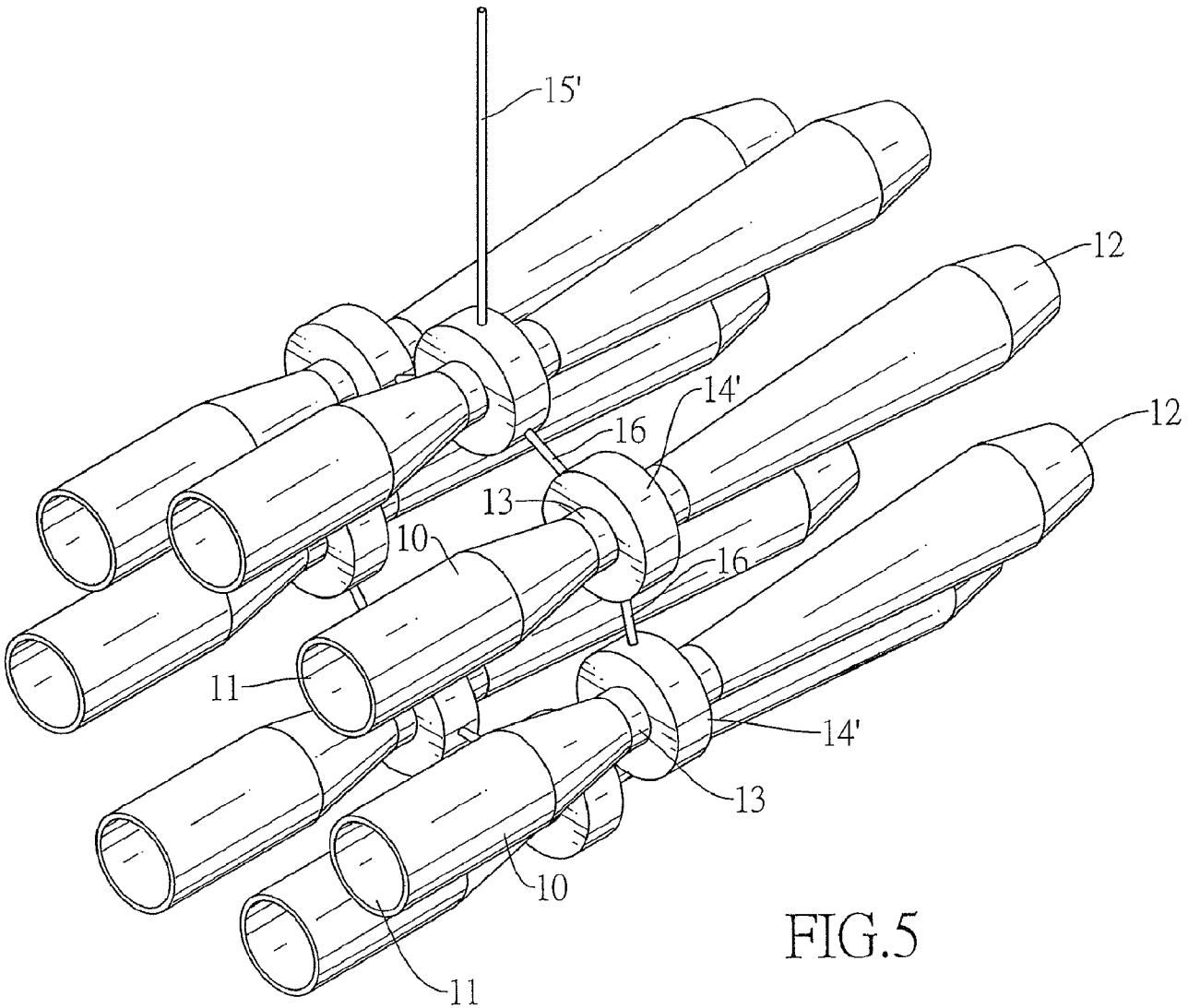
FIG. 5 is a perspective view of a second embodiment of a nebulizing device of the aerating nozzle assembly in accordance with the present invention.
Figure 6:
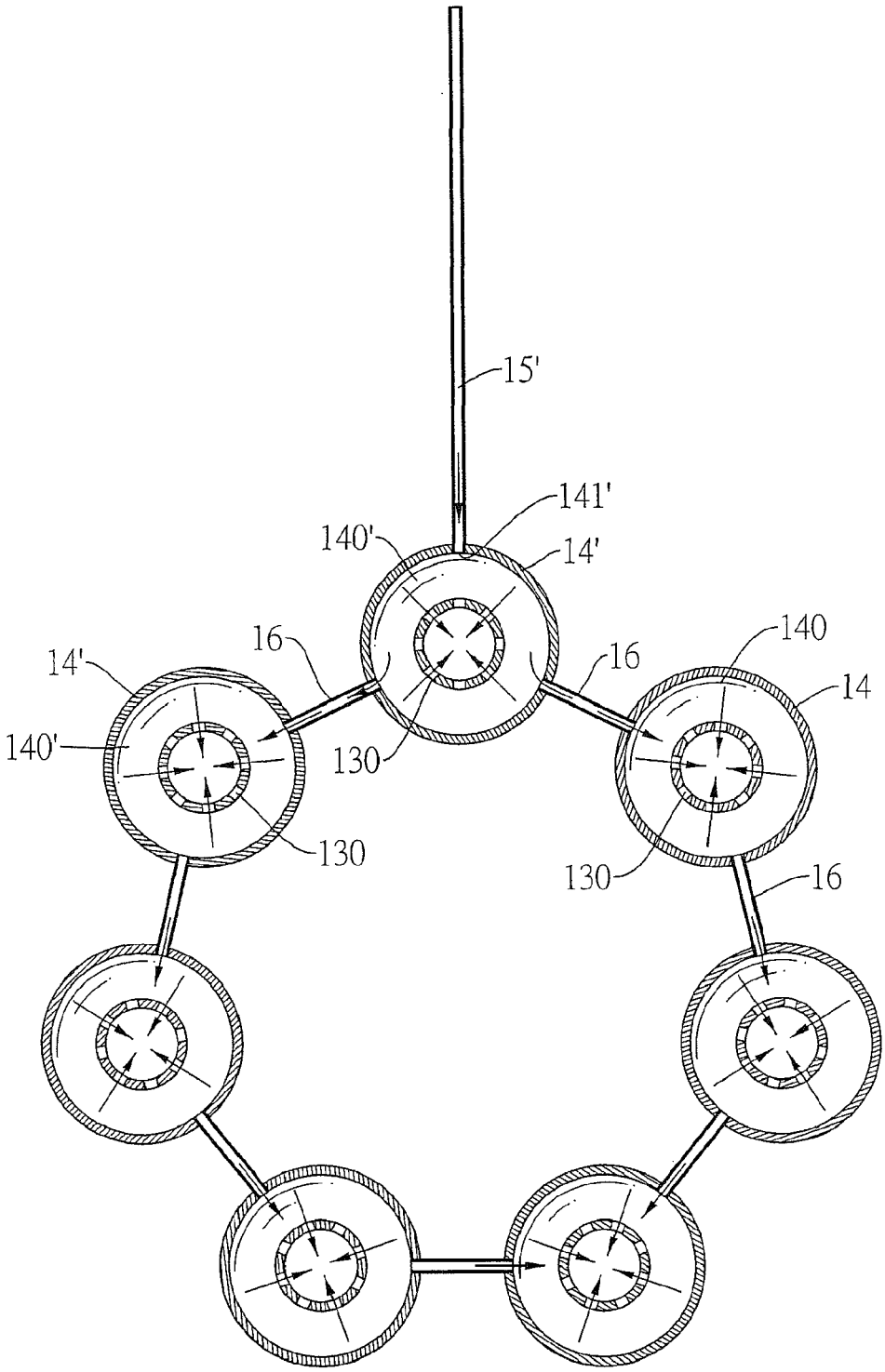
FIG. 6 is an operational cross sectional end view of the nebulizing device in FIG. 5.

With reference to FIGS. 5 and 6, in a second embodiment of the present invention, the nebulizing device comprises multiple bodies (10), multiple annular air casings (14'), multiple acceleration caps (12), at least one ambient air tube (15') and multiple connecting air tubes (16).

The bodies (10) are arranged circularly and are parallel to each other. Each body (10) is tubular and has an inlet (11), an outlet, a middle, a channel and a constriction (13). The channel is defined longitudinally through the body (10). The constriction (13) is formed in the middle of the body (10) and has a constricted space and a plurality of air holes (130). The constricted space is defined in the constriction (13) and communicates with the channel. The air holes (130) are formed through the constriction (13) diametrically and communicate with the constricted space.

The annular air casings (14') are airtightly formed respectively around the constrictions (13) of the bodies (10), and each annular air casing (14') has an air chamber (140'), an annular surface and at least one air supply hole (141'). The air chamber (140') is formed inside the annular air casing (14') and communicates with the air holes (130). The at least one air supply hole (141') is formed through the annular surface and communicates with the air chamber (140').

The acceleration caps (12) are respectively formed concentrically on and constricts the outlets of the bodies (10), and each acceleration cap (12) is a hollow frustum and defines a constricted inner surface and a discharging hole (120) being adjacent to the constricted inner surface and communicating with the channel of the body (10).

The at least one ambient air tube (15') attaches securely to one of the annular air casings (14') and communicates the air chamber (140') of the annular air casing (14') that the at least one ambient air tube (15') attaches to with outer environment.

The connecting air tubes (16) are respectively connected to the annular air casings (14') so as to communicate all of the air chambers (140') of the annular air casings (14').

With an external compressor and liquid supplying pipes connecting to the inlets (11) of the bodies (10), pressed liquid may pass through the constricted spaces of the bodies (10) and mixed up with the air coming in from all of the air holes (130) that communicated with the at least one ambient air tube (15') and the connecting tubes (16) to form a great quantity of spray. When the spray flow through the air channels of the bodies (10) and into the acceleration caps (12), the spray will be accelerated via the constricted inner surfaces and eventually discharged from the discharging holes (120) of the acceleration caps (12).

In this embodiment, multiple pipes may be arranged between the discharging holes (120) and said turbine (18) to translate spray for accelerating by the propeller (180) of the turbine (18).

Figure 9:
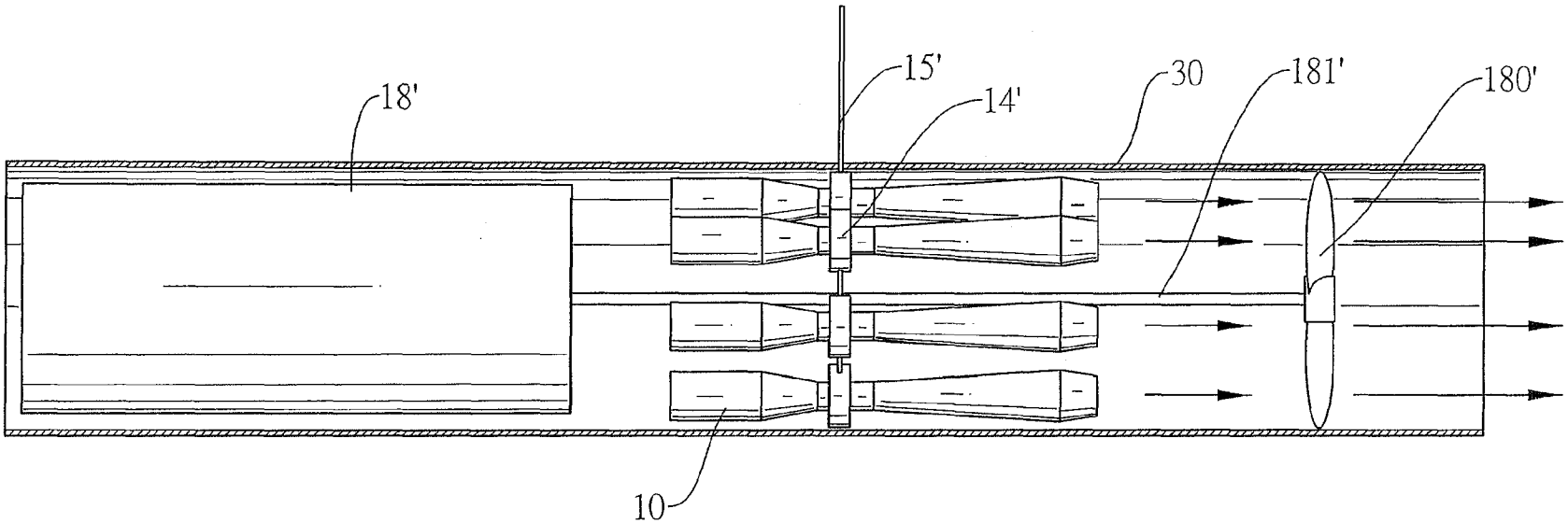
FIG. 9 is an operational cross sectional side view of a fifth embodiment of the aerating nozzle assembly in accordance with the present invention.
Figure 10:
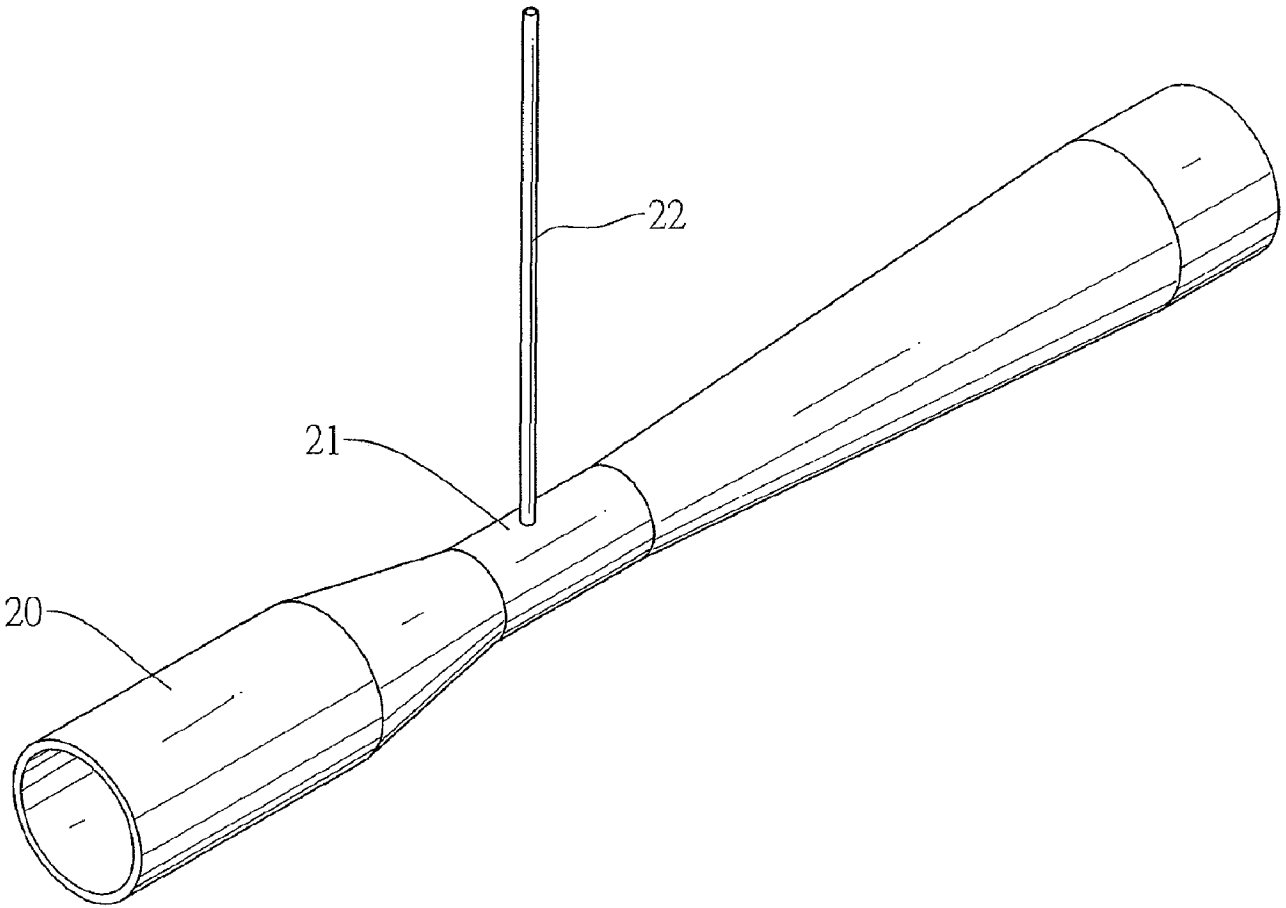
FIG.10 PRIOR ART
FIG. 10 is a perspective view of a nebulizing device of the aerating nozzle assembly in accordance with prior art.
Figure 11:
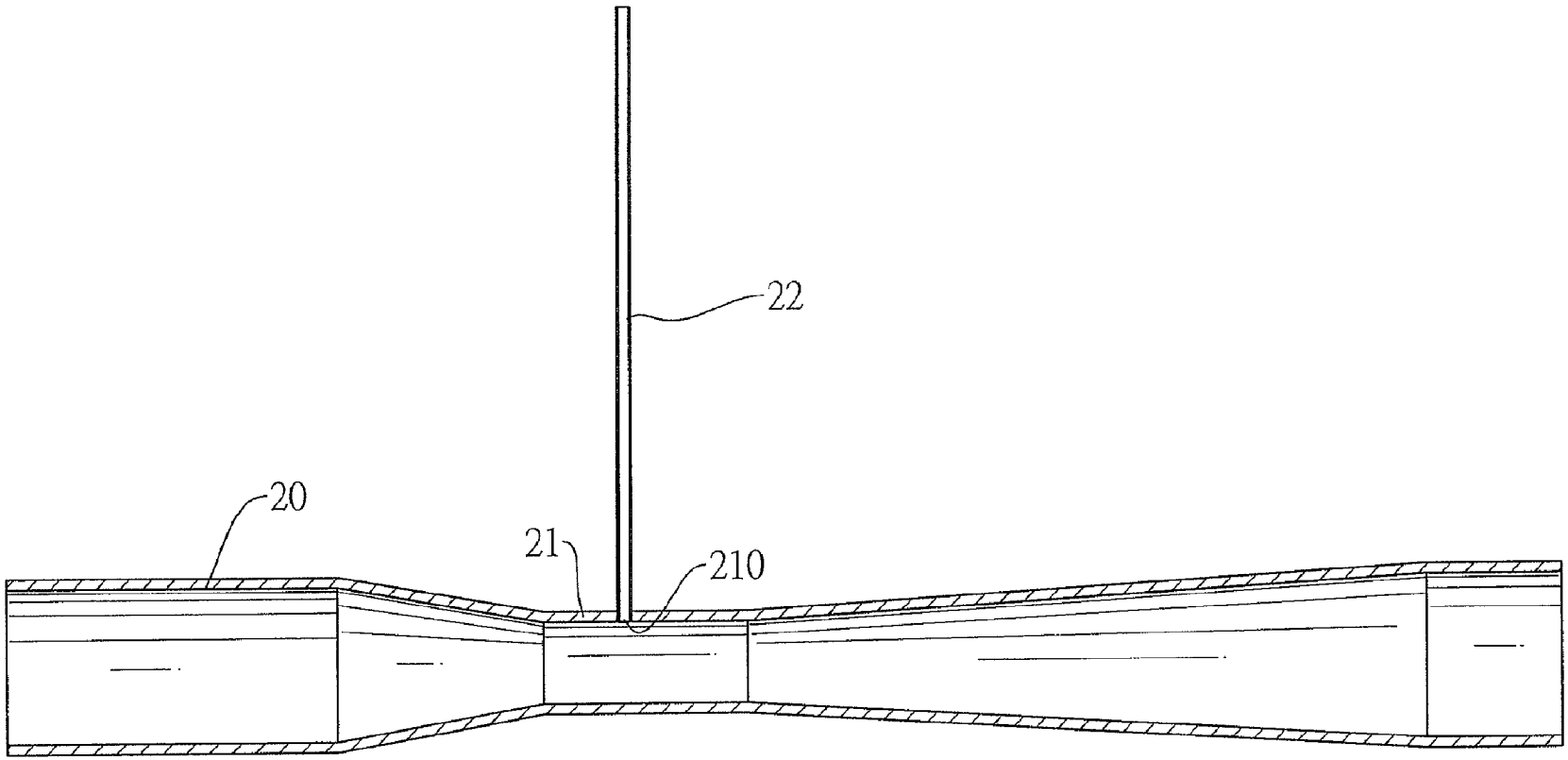
FIG.11 PRIOR ART
FIG. 11 is a cross sectional side view of the nebulizing device in FIG. 7.

With further reference to FIG. 9, in the fifth embodiment, an aerating nozzle assembly comprises a housing (30), a nebulizing device and a turbine (18').

The housing (30) may be tubular and has a middle, a proximal end, a distal end and an opening formed in the distal end.

The nebulizing device is structurally the same with the nebulizing device shown in FIGS. 5 and 6, and is mounted in the middle of the housing (30).

The turbine (18') is mounted securely in the proximal end of the housing (30) and has a shaft (181') having an end extending through the nebulizing device and mounting with a propeller (180') to accelerate the spray out from the opening of the housing (30).

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. An aerating nozzle assembly having a nebulizing device comprising multiple bodies being arranged circularly and being parallel to each other, each body being tubular and having an inlet;

an outlet;

a middle;

a channel being defined longitudinally through the body; and a constriction being formed in the middle of the body and having a constricted space being defined in the constriction and communicating with the channel; and a plurality of air holes being formed through the constriction diametrically and communicating with the constricted space;

multiple annular air casings being airtightly formed respectively around the constrictions of the bodies, and each annular air casing defining an air chamber communicating with all of the air holes in a corresponding constriction;

multiple connecting air tubes being respectively connected to the annular air casings so as to communicate all of the air chambers of the annular air casings;

at least one ambient air tube attached securely to one of the annular air casings and communicating the air chamber of the annular air casing that the at least one ambient air tube attaches to with an outer environment.

2. The aerating nozzle assembly as claimed in claim 1, wherein the nebulizing device further has multiple acceleration caps being respectively formed concentrically on and constricting the outlets of the bodies, and each acceleration cap being a hollow frustum and defining a constricted inner surface; and a discharging hole adjacent the inner surface and communicating with the channel of a corresponding body.

3. The aerating nozzle assembly as claimed in claim 2, further comprising a housing being tubular and having a middle, a proximal end, a distal end and an opening formed in the distal end, and the nebulizing device being mounted in the middle of the housing; and a turbine being mounted securely in the proximal end of the housing and having a shaft having an end extending through the nebulizing device and mounting with a propeller to accelerate a spray out from the opening of the housing.

* * * * *